US011063394B2

(12) United States Patent
Tsao et al.

(10) Patent No.: US 11,063,394 B2
(45) Date of Patent: Jul. 13, 2021

(54) ELECTRICAL CONNECTOR

(71) Applicant: PEGATRON CORPORATION, Taipei (TW)

(72) Inventors: Wei-Chun Tsao, Taipei (TW); Wei-Hsin Chen, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/727,607

(22) Filed: Dec. 26, 2019

(65) Prior Publication Data

US 2020/0227864 A1 Jul. 16, 2020

(30) Foreign Application Priority Data

Jan. 11, 2019 (TW) ..... 108101081

(51) Int. Cl.
*H01R 13/6581* (2011.01)
*H01R 12/70* (2011.01)
(Continued)

(52) U.S. Cl.
CPC ..... *H01R 13/6581* (2013.01); *H01R 12/707* (2013.01); *H01R 13/035* (2013.01);
(Continued)

(58) Field of Classification Search
CPC .. H01R 13/6581; H01R 12/57; H01R 12/707; H01R 13/6485; H01R 13/6599; H01R 13/035
See application file for complete search history.

(56) References Cited

U.S. PATENT DOCUMENTS 5,641,291 A 6/1997 Sueki et al.
6,135,791 A * 10/2000 Wang ..... H05K 7/1076 439/342
(Continued)

FOREIGN PATENT DOCUMENTS

CN 201528063 7/2010
CN 103515797 1/2014
(Continued)

OTHER PUBLICATIONS

"Search Report of Europe Counterpart Application", dated Jul. 8, 2020, p. 1-p. 5.
(Continued)

*Primary Examiner* — Briggitte R. Hammond
(74) *Attorney, Agent, or Firm* — J.C. Patents

(57) ABSTRACT

A connector includes a base, a transmission interface, a shielding cover and a shielding layer. The base includes a slot. The transmission interface includes a clamping portion and a plugboard. The clamping portion is clamped in the slot and a portion of the plugboard protrudes out of the base. The shielding cover has an accommodation space and a shielding layer. The accommodation space is disposed to accommodate the base and the transmission interface, and the shielding layer is electroplated on an inner side surface of the shielding cover. The shielding cover covers the base and the transmission interface and is disposed to block electromagnetic waves generated by the transmission interface.

10 Claims, 3 Drawing Sheets

(51) Int. Cl.

| | |
|---|---|
| ***H01R 13/648*** | (2006.01) |
| ***H01R 13/03*** | (2006.01) |
| ***H01R 12/57*** | (2011.01) |
| ***H01R 13/6599*** | (2011.01) |

(52) U.S. Cl.
CPC ..... *H01R 13/6485* (2013.01); *H01R 12/57* (2013.01); *H01R 13/6599* (2013.01)

(56) References Cited

U.S. PATENT DOCUMENTS

| | | | | |
|---|---|---|---|---|
| 9,685,718 | B1 | 6/2017 | Wang | |
| 9,728,900 | B1 * | 8/2017 | Tsai | H01R 13/516 |
| 2018/0220557 | A1 | 8/2018 | Heller | |

FOREIGN PATENT DOCUMENTS

| | | |
|---|---|---|
| CN | 104966916 | 10/2015 |
| CN | 108923158 | 11/2018 |
| CN | 208352551 | 1/2019 |
| JP | 2000228259 | 8/2000 |
| TW | 201724665 | 7/2017 |
| TW | I597900 | 9/2017 |
| WO | 2018094941 | 5/2018 |

OTHER PUBLICATIONS

"Office Action of Korea Counterpart Application", dated Dec. 4, 2020, with English translation thereof, p. 1-p. 8.
Office Action of China Counterpart Application, dated Dec. 16, 2020, p. 1-p. 9.

* cited by examiner

ELECTRICAL CONNECTOR

CROSS-REFERENCE TO RELATED APPLICATION

This application claims the priority benefit of Taiwan application serial no. 108101081, filed on Jan. 11, 2019. The entirety of the above-mentioned patent application is hereby incorporated by reference herein and made a part of this specification.

BACKGROUND

Technical Field

The present invention relates to a connector, and in particular, to a connector capable of suppressing electromagnetic interference.

Description of Related Art

With the development of electronic technologies, various electronic products such as televisions, computers, smartphones and various communications devices have become increasingly popular. The accompanying disadvantage is that the living environment is filled with electromagnetic waves generated by the electronic products. Therefore, the electromagnetic interference and noise tolerance of the electronic products during data transmission have been gradually concerned by governments and enterprises.

The interference between a wireless network base station and a third generation universal serial bus (USB 3.0) during signal transmission is more serious in a consumer product. To resolve the problem of the electromagnetic interference, an electromagnetic shielding mask is disposed around an existing third generation universal serial bus (USB3.0) connector to reduce the emission of the electromagnetic waves. However, most of the existing electromagnetic shielding masks are made of metal (tinplate) and use a dual in line package (DIP) process, and this requires relatively high manufacturing costs and labor costs. Further, the overall structure of the existing electromagnetic shielding mask still includes a plurality of apertures. Consequently, some of the electromagnetic waves may be emitted from the apertures to the environment, affecting electromagnetic shielding efficiency.

In addition, the appearance of the existing electromagnetic shielding mask is also prone to the accumulation of static electricity, and finally leads to the problem of electrostatic discharge, causing the malfunction of a transmission signal. This indicates that a grounding property of the existing electromagnetic shielding mask is insufficient.

SUMMARY

The present invention provides a connector. The connector may enhance electromagnetic shielding efficiency to improve the problem of emission and interference of electromagnetic waves and may also reduce a labor requirement to cut down manufacturing costs.

The connector of the embodiment is adapted to be disposed on a circuit board. The connector includes a base, a transmission interface, a shielding cover and a shielding layer. The base includes a slot, and the base is fixed on the circuit board. The transmission interface includes a clamping portion and a plugboard. The clamping portion is clamped in the slot and a portion of the plugboard protrudes out of the base. The shielding cover has an accommodation space. The accommodation space is configured to accommodate the base and the transmission interface. The shielding layer is electroplated on an inner side surface of the shielding cover. The shielding cover covers the base and the transmission interface and is disposed to block an electromagnetic wave generated by the transmission interface.

Based on the above, the connector of the present invention is divided into the base, the transmission interface and the shielding cover. The base is soldered on the circuit board by using a surface mount (SMD) technology. The SMD technology replaces the conventional manual mounting through machine automatic mounting, to reduce manufacturing costs and enhance the product yield. Further, in the present invention, the shielding cover is used to accommodate and cover the base and the transmission interface, and the shielding layer is added onto the shielding cover, to block the electromagnetic waves of the transmission interface and restrict most of the electromagnetic waves to the accommodation space, thereby preventing the electromagnetic waves from being transmitted outwards and causing electromagnetic interference to other electronic devices.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
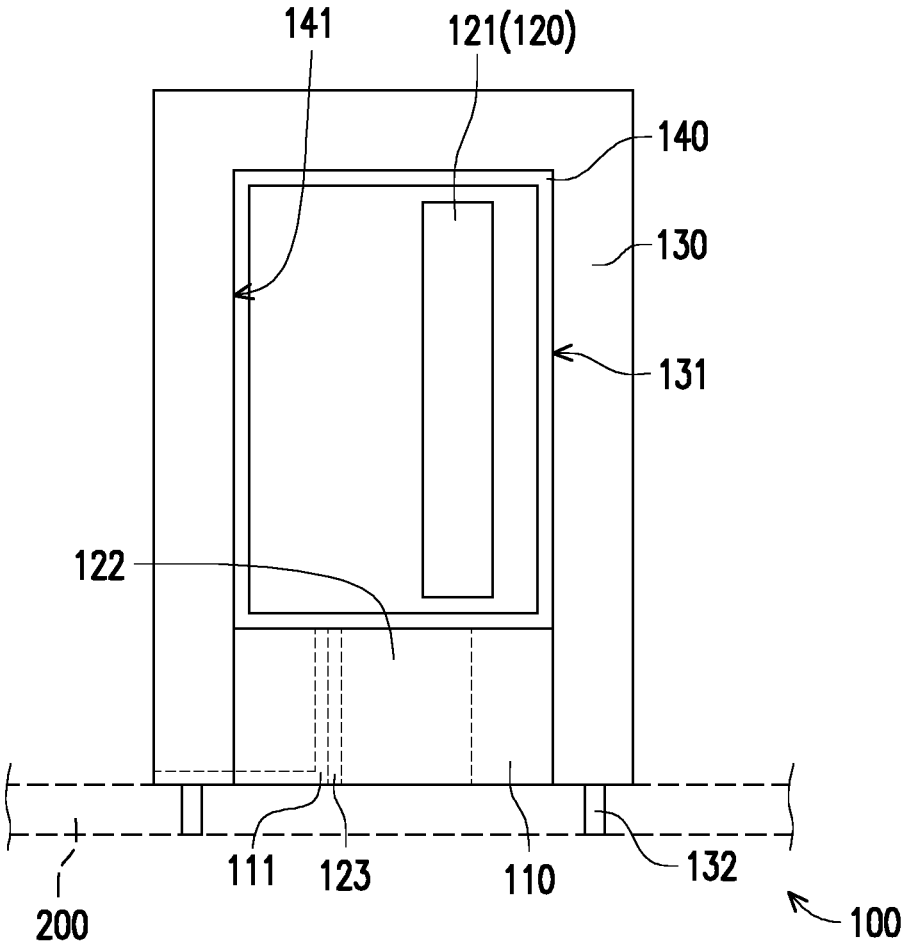
FIG. 1 is a schematic diagram of a connector according to an embodiment of the present invention.
Figure 2:
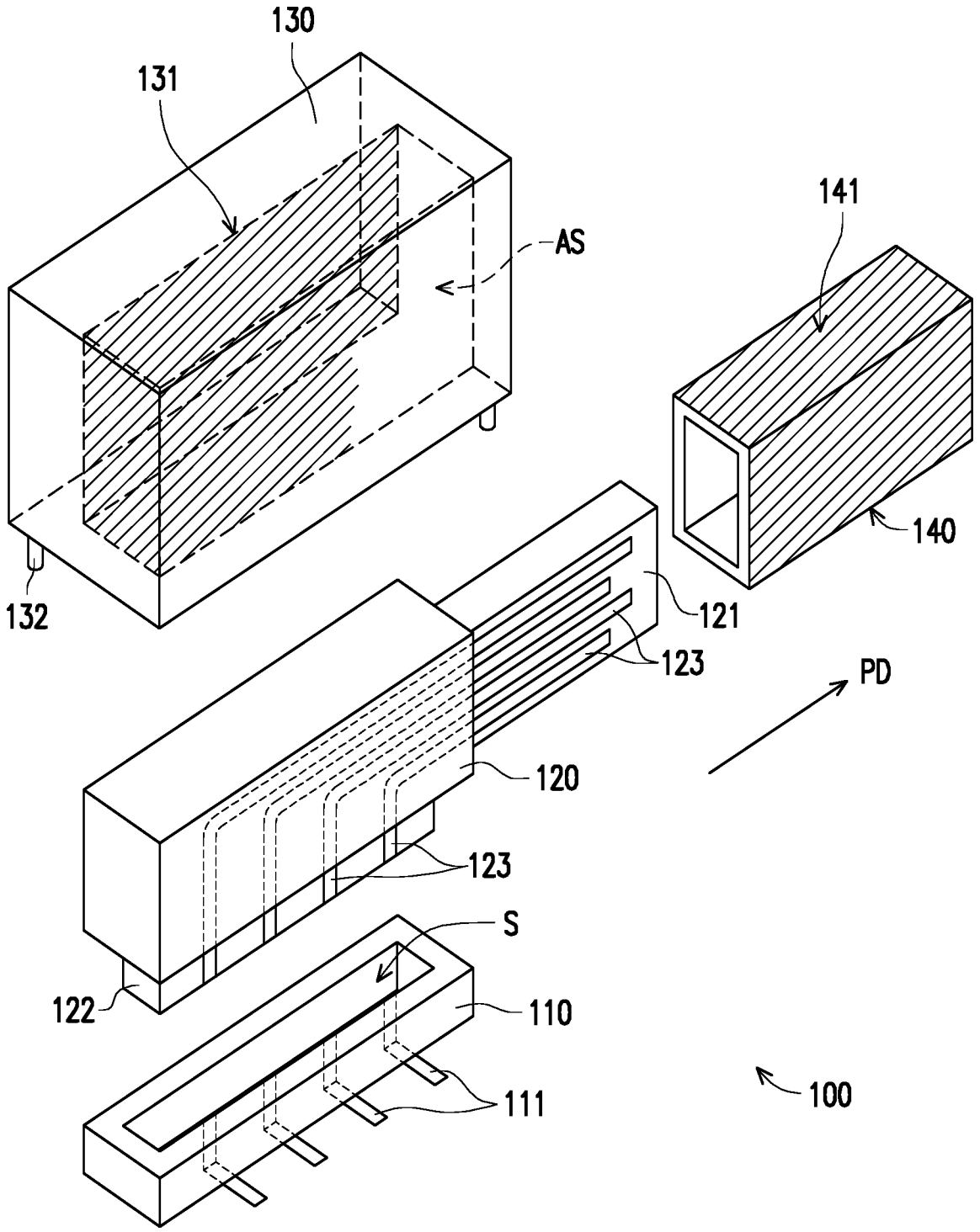
FIG. 2 is an exploded view of the connector in FIG. 1.
Figure 3:
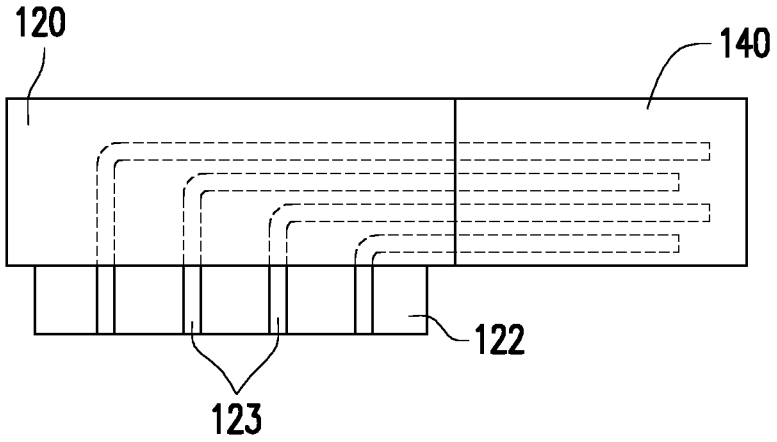
FIG. 3 is a schematic diagram of a transmission interface in FIG. 2.

FIG. 1 is a schematic diagram of a connector according to an embodiment of the present invention. FIG. 2 is an exploded view of the connector in FIG. 1. FIG. 3 is a schematic diagram of a transmission interface in FIG. 2.

Referring to FIG. 1, in this embodiment, a connector 100 is adapted to be disposed on a circuit board. For example, the connector 100 is a third-generation universal serial bus (USB3.0/3.1) configured to connect to a corresponding connector or a thumb drive complying the same specification for supplying power or transmitting an electronic signal. In another embodiment, the connector may also be another type of bus, and is not limited to the third-generation universal serial bus (USB3.0/3.1). In addition, the bus is a standardized manner of exchanging data between computer components, that is, the bus provides data transmission and control logic for the components in a common manner.

Referring to FIG. 1 to FIG. 3, specifically, the connector 100 of the present invention includes a base 110, a transmission interface 120, a shielding cover 130 and a shielding layer 131.

The base 110 includes a slot S and a plurality of first pins 111. The slot S is grooved on a top surface of the base 110. The plurality of first pins 111 separately extends from the inside of the slot S to the outside of the base 110. The plurality of respective first pins 111 corresponds to a plurality of standard pins (+, −, D+, D−) of the third-generation universal serial bus. The plurality of first pins 111 is soldered on the circuit board 200 through a surface mount (SMD) technology, to be electrically connected to the circuit board 200.

The transmission interface 120 includes a plugboard 121, a clamping portion 122 and a plurality of second pins 123. The clamping portion 122 extends downward (that is, in a direction of the base 110) and is clamped in the slot S. A portion of the plugboard 121 protrudes out of the base 110, that is, the plugboard 121 protrudes out of the base 110 in a horizontal direction PD. The clamping portion 122 is perpendicular to the plugboard 121 to form an L shape. The plurality of second pins 123 separately extends from the plugboard 121 to the clamping portion 122 and has the same L shape, and the plurality of respective second pins 123 is electrically coupled to the corresponding plurality of first pins 111.

Further, the plugboard 121, the clamping portion 122 and the plurality of pins 123 are integrally formed. For example, the plurality of pins 123 is embedded in the plugboard 121 and the clamping portion 122 by using an injection molding technology.

In addition, the appearance and the size of the clamping portion 122 correspond to the appearance and the size of the slot S for engaging with each other. For example, in order to enhance the stability of the structure in which the transmission interface 120 is connected to the base 110, the length of the clamping portion 122 may be extended and the depth of the slot S may be increased correspondingly, so that the L-shaped structure of the transmission interface 120 can resist an insertion and extraction force against other components.

The shielding cover 130 has an accommodation space AS and a plurality of positioning posts 132. The accommodation space AS is configured to accommodate the base 110 and the transmission interface 120, and the shielding layer 131 is disposed on an inner side surface of the shielding cover 130. For example, the shielding layer 131 is electroplated on the inner side surface of the shielding cover 130. The plurality of positioning posts 132 is disposed outside the accommodation space AS, and soldered on the circuit board 200. The shielding cover completely covers the base 110 and the transmission interface 120.

Further, mostly suppression of electromagnetic interference (EMI) is achieved by means of shielding housing and shielding slot. By shielding, filtering or grounding, the circuit where the interference is generated is isolated and a sensitive circuit has a better the anti-interference ability. For example, a material of the shielding layer may include: a metal can, a thin metal sheet, a foil strip, a conductive fabric, a coating (such as conductive paint, zinc wire spraying and the like) and plating (electroplating and evaporation of a metal material).

In addition, the base 110 is fixed on the circuit board 200. When the shielding cover 130 covers the base 110 and the transmission interface 120, the shielding cover 130 and the shielding layer 131 are configured to block electromagnetic waves generated by the transmission interface 120.

Referring to FIG. 1 to FIG. 3, the connector 100 further includes an outer housing 140 sleeved outside the plugboard 121 of the transmission interface 120 and adapted to have contact with the inner side surface of the shielding cover 130. The outer housing 140 has a length corresponding to the extended length of the plugboard 121, and is adapted to completely cover a peripheral portion of the plugboard 121. Only the opening for connecting with an external component is kept, thereby minimizing the number of propagation paths of the electromagnetic waves.

Further, a conductive layer 141 is disposed on an outer side surface of the outer housing 140 and is electrically coupled to the shielding layer 131 of the shielding cover 130 to achieve the grounding efficiency, thereby reducing the electromagnetic interference generated by the transmission interface 120.

In addition, the shielding cover 130 is made of a liquid crystal polymer, and has a better mechanical characteristic and heat resistance, compared to the existing engineering plastic. For example, the liquid crystal polymer may be used continuously at an ambient temperature of 230 to 300 degrees in centigrade without its mechanical strength degraded. In addition, the liquid crystal polymer further has excellent flame retardance, and may achieve protection efficiency of non-continuous combustion and non-spontaneous combustion when encountering a combustion condition.

By using the liquid crystal polymer, the shielding cover 130 of this embodiment has a better insulation characteristic, and the dielectric strength of the shielding cover 130 is much greater than the dielectric strength of the existing metal material. Therefore, compared to the existing metal material, the shielding cover may prevent an electrostatic discharge (ESD) phenomenon, thereby reducing the possibility of damage to the component or the connector 100.

Based on the above, the connector of the present invention is divided into the base, the transmission interface and the shielding cover. The base is adapted to be soldered on the circuit board by using a surface mount (SMD) technology. The SMD technology uses machine automatic mounting and replaces the past manual mounting to reduce manufacturing costs and enhance the product yield. Further, in the present invention, the shielding cover is used to accommodate and cover the base and the transmission interface, and the shielding layer is added onto the shielding cover, to block the electromagnetic waves of the transmission interface and limit most of the electromagnetic waves in the accommodation space, thereby preventing the electromagnetic waves from emitting outwards and from causing electromagnetic interference to other electronic devices.

In addition, through a metal shielding layer formed by electroplating inside the shielding cover, a grounding characteristic of the shielding layer is enhanced, so that suppression efficiency of the electromagnetic waves of the transmission interface is enhanced.

Although the present invention is disclosed with reference to embodiments above, the embodiments are not intended to limit the present invention. Any person of ordinary skill in the art may make some variations and modifications without departing from the spirit and scope of the invention, and therefore, the protection scope of the present invention should be defined in the following claims.

What is claimed is:

1. An electrical connector, adapted to be disposed on a circuit board, wherein the connector comprises:

a base, comprising a slot, wherein the base is fixed on the circuit board;

a transmission interface, comprising a plugboard and a clamping portion, wherein the clamping portion is clamped in the slot and a portion of the plugboard protrudes out of the base;

a shielding cover, having an accommodation space, wherein the accommodation space is configured to accommodate the base and the transmission interface; and a shielding layer, electroplated on an inner side surface of the shielding cover, wherein the shielding cover covers the base and the transmission interface and is configured to block electromagnetic waves generated by the transmission interface, wherein the shielding cover completely covers the base and the transmission interface.

2. The electrical connector according to claim 1, wherein the base comprises a plurality of first pins separately extending from the inside of the slot to the outside of the base, and the first pins are soldered on the circuit board.

3. The electrical connector according to claim 2, wherein the transmission interface comprises a plurality of second pins separately extending from the plugboard to the clamping portion, and the second pins are electrically coupled to the first pins respectively.

4. The electrical connector according to claim 3, wherein the plugboard, the clamping portion and the second pins are integrally formed.

5. The electrical connector according to claim 1, wherein the plugboard protrudes out of the base in a horizontal direction, and the clamping portion is perpendicular to the plugboard to form an L shape.

6. The electrical connector according to claim 1, wherein the shielding cover comprises a plurality of positioning posts disposed outside the accommodation space, and the positioning posts are soldered on the circuit board.

7. The electrical connector according to claim 1, further comprising an outer housing sleeved on the plugboard and adapted to contact the inner side surface of the shielding cover.

8. The electrical connector according to claim 7, wherein a conductive layer adapted to be electrically coupled to the shielding layer is disposed on an outer side surface of the outer housing.

9. The electrical connector according to claim 1, wherein the shielding cover is made of a liquid crystal polymer.

10. The electrical connector according to claim 1, wherein the transmission interface complies with a transmission specification of a third-generation universal serial bus (USB3.0/3.1).

* * * * *